US005728673A

United States Patent [19]

Mermelstein et al.

[11] Patent Number: 5,728,673

[45] Date of Patent: Mar. 17, 1998

[54] PROCESS FOR MAKING A FLUID, STABLE LIQUID FABRIC SOFTENING COMPOSITION INCLUDING DISPERSIBLE POLYOLEFIN

[75] Inventors: Robert Mermelstein; John Henry Shaw, Jr., both of Cincinnati, Ohio

[73] Assignee: The Procter & Gamble Company, Cincinnati, Ohio

[21] Appl. No.: 594,457

[22] Filed: Jan. 31, 1996

[51] Int. Cl.[6] ..... D06M 13/00

[52] U.S. Cl. ..... 510/475; 510/499; 510/522

[58] Field of Search ..... 510/499, 475, 510/522

[56] References Cited

U.S. PATENT DOCUMENTS

| | | | |
|---|---|---|---|
| 3,475,207 | 10/1969 | Berch et al. | 117/143 |
| 3,565,840 | 2/1971 | Mirabile et al. | 260/23 |
| 3,574,520 | 4/1971 | Aldrich | 8/115.6 |
| 3,734,686 | 5/1973 | Douglas | 8/137 |
| 3,749,691 | 7/1973 | Kandathil | 260/29.6 |
| 3,822,145 | 7/1974 | Liebowitz et al. | 117/139.5 |
| 3,826,682 | 7/1974 | Liebowitz et al. | 117/139.5 |
| 3,984,335 | 10/1976 | Ciko et al. | 252/8.6 |
| 4,089,786 | 5/1978 | Ciko et al. | 252/8.8 |
| 4,211,815 | 7/1980 | Deiner | 428/290 |
| 4,252,656 | 2/1981 | Liebowitz et al. | 252/8.8 |
| 4,426,304 | 1/1984 | Ciko et al. | 252/8.75 |
| 4,474,668 | 10/1984 | Petzold et al. | 252/8.6 |
| 4,767,547 | 8/1988 | Straathof et al. | 252/8.8 |
| 4,975,091 | 12/1990 | Becker et al. | 8/115.66 |
| 5,019,281 | 5/1991 | Singer et al. | 252/8.8 |
| 5,047,065 | 9/1991 | Vogel et al. | 8/115.6 |
| 5,051,250 | 9/1991 | Patel et al. | 424/70 |
| 5,078,747 | 1/1992 | Kastele et al. | 8/181 |
| 5,185,088 | 2/1993 | Hartman et al. | 252/86 |
| 5,213,716 | 5/1993 | Patel et al. | 252/547 |
| 5,238,731 | 8/1993 | Blanch et al. | 428/266 |
| 5,310,783 | 5/1994 | Bernheim et al. | 524/837 |
| 5,346,642 | 9/1994 | Patel et al. | 252/174.21 |
| 5,500,138 | 3/1996 | Bacon et al. | 252/8.8 |
| 5,599,786 | 2/1997 | Siklosi et al. | 510/522 |

FOREIGN PATENT DOCUMENTS

| | | | |
|---|---|---|---|
| 118611 | 9/1984 | European Pat. Off. | D06M 13/16 |
| 412324 | 2/1991 | European Pat. Off. | D06M 15/227 |
| 535 437 | 4/1993 | European Pat. Off. | D06M 15/643 |
| 535 438 | 4/1993 | European Pat. Off. | D06M 15/17 |
| 234 687 | 4/1986 | Germany | C11D 01/62 |
| 3926-005 | 2/1991 | Germany | C08J 03/05 |
| 44 35 386 A | 4/1996 | Germany . | |
| 1162898 | 8/1969 | United Kingdom | C07C 69/52 |
| 2 095 285 | 9/1982 | United Kingdom | C14C 9/00 |
| WO 91/19037 | 12/1991 | WIPO | D06M 15/643 |

OTHER PUBLICATIONS

Derwent Publications Ltd., London, GB; Class A87, AN 85-120898, XP002030323, Gaikova et al.: "Compsn. for imparting crease resistance to wet linen—includes qua. ammonium slat, polyvinyl acetate emulsion as softener and supplementary acetic acid to increase strength" & SU 1 118 731 A (Bast Fibres Ind Res), 15 Oct. 1984; see abstract.

U.S. application No. 08/594,956, Baker et al., filed Jan. 31, 1996.

U.S. application No. 08/594,546, Hartman et al., filed Jan. 1996.

*Primary Examiner*—Jacqueline V. Howard

*Attorney, Agent, or Firm*—Richard S. Echler, Sr.; Kim William Zerby; Brian M. Bolam

[57] ABSTRACT

A process for making a liquid fabric softening composition is provided. The process comprises the steps of:

(A) forming an aqueous phase comprising a dispersible polyolefin having a temperature of from about 50° C. to about 90° C.;

(B) forming a molten organic phase having a temperature of from about 50° C. to about 90° C., the molten organic phase including a molten fabric softening compound;

(C) injecting the molten organic phase into the aqueous phase;

(D) mixing during the injection to form a mixture;

(E) adding a solution of an electrolyte to the mixture;

(F) cooling the mixture to a temperature of from about 15° C. to about 30° C.; and (G) adding an additional amount of the electrolyte to form a liquid fabric softening composition.

Preferably, the dispersible polyolefin is added as an emulsion or suspension of polyolefin and is an oxidized polyethylene. Additional ingredients such as chelating agents, perfumes, chlorine scavenging agents, phase stabilizing agents, dyes and mixtures may also be added.

21 Claims, No Drawings

PROCESS FOR MAKING A FLUID, STABLE LIQUID FABRIC SOFTENING COMPOSITION INCLUDING DISPERSIBLE POLYOLEFIN

TECHNICAL FIELD

The present invention relates to a method for making a liquid fabric softening composition including dispersible polyolefin, and more particularly to a liquid fabric softening composition including dispersible polyethylene.

BACKGROUND OF THE INVENTION

In recent years, consumer desirability for durable press fabric garments, particularly cotton fabric garments, has risen. Durable press garments include those garments which resist wrinkling of the fabric both during wear and during the laundering process. Durable press garments can greatly decrease the hand work associated with laundering by eliminating ironing sometimes necessary to prevent wrinkling of the garment. However, in most commercially available durable press fabrics, the fabric's ability to resist wrinkling is reduced over time as the garment is repeatedly worn and laundered.

Consumer desirability for fabric softening compositions has also risen. Fabric softening compositions impart several desirable properties to treated garments including softness and static control. Fabric softness of laundered garments is typically achieved by delivering a quaternary ammonium compound to the surface of the fabric. However, due to the fatty character of many of the quaternary ammonium compounds commercially employed as fabric softening agents, the ability of fabrics treated with these agents to absorb water may decrease. This decrease in water absorbency can be undesirable for certain fabric articles such as terry towels where water absorbency is an important feature.

Both features of improved water absorbency and anti-wrinkling features can be provided by including a polyolefin in the fabric softening composition. However, formulation of fabric softening compositions including a polyolefin can be quite difficult. The polyolefin is substantially insoluble in water and must be dispersed or suspended in a liquid. Also, the fabric softening component of a liquid fabric softening composition also is substantially insoluable in water and must be dispersed or suspended as a fine particle or vesicles in the composition due to the fatty character of the softening component. Thus, both the polyolefin and the fabric softening compound must be added to the composition yet remain suspended or dispersed within the composition in order to formulate a commercially usable product.

Accordingly, there is a need for a method of making a liquid fabric softening composition including a dispersible polyolefin, and, in particular, a dispersible polyethylene. This need is met by the present invention wherein a process for making a liquid fabric softening composition including a dispersible polyolefin is provided. The process of the present invention involves the addition of the dispersible polyolefin before the formation of the softener vesicles.

BACKGROUND ART

U.S. Pat. Nos. 3,984,335 and 4,089,786 disclose souring and softening compositions for textile fabrics. U.S. Pat. No. 3,749,691 discloses detergent compatible fabric softening compositions. European Patent 118,611 discloses compositions for softening fibrous materials, particularly textile fabrics. U.S. Pat. No. 3,734,686 discloses compositions for treating carpet and pile fabrics. U.S. Pat. No. 3,822,145 discloses fabric softening foams which are sprayed into a tumble dryer. U.S. Pat. No. 5,019,281 discloses softhand agents for textile applications. Japanese Patent Application JP53035085 discloses aerosol sizing agents.

SUMMARY OF THE INVENTION The present invention relates to a process for making a liquid fabric softening composition including a dispersible polyolefin. The process comprises the steps of:

(A) forming an aqueous phase comprising a dispersible polyolefin in a water seat having a temperature of from about 50° C. to about 90° C.;

(B) forming a molten organic phase having a temperature of from about 50° C. to about 90° C., the molten organic phase including a molten fabric softening compound;

(C) injecting the molten organic phase into the aqueous phase;

(D) mixing during the injection to form a mixture;

(E) adding a solution of an electrolyte to the mixture;

(F) cooling the mixture to a temperature of from about 15° C. to about 30° C.; and (G) adding an additional amount of the electrolyte to form a liquid fabric softening composition.

The dispersible polyolefin preferably is added as an emulsion or suspension of polyolefin. The emulsion may comprise from about 15 to about 35% by weight of polyolefin and an emulsifier. The ratio of emulsifier to polyolefin in the emulsion may be from about 1:10 to about 3:1. The polyolefin is preferably polyethylene, more preferably a modified polyethylene and most preferably an oxidized polyethylene The emulsifier is preferably a cationic or nonionic surfactant. The pH of the end composition is preferably from about 2 to about 5.

The process may further include the steps of adding a chelating agent in step (E) of the above process, adding an anti-foaming agent to step (A) of the above process or adding a compound selected from the group consisting of chelating agents, perfumes, chlorine scavenging agents, phase stabilizing agents, dyes and mixtures thereof before step (G) of the process. Preferably, a sufficient amount of electrolyte is added such that the viscosity of the liquid fabric softening composition is less than about 100 centipoise. The electrolyte may be selected from the group consisting of calcium chloride, magnesium chloride, and mixtures thereof. The process may also include the step of high shear milling the mixture after addition of the electrolyte yet before cooling.

In an additional aspect of the present invention, a process of making a liquid fabric softening composition including a dispersible polyethylene is provided. The process comprises the steps of:

(A) forming an aqueous phase comprising a dispersible polyethylene and an anti-foaming agent in a water seat having a temperature of from about 50° C. to about 90° C.;

(B) forming a molten organic phase having a temperature of from about 50° C. to about 90° C., the molten organic phase including molten N,N-di(tallowyl-oxyethyl)-N,N-dimethyl ammonium chloride and a low molecular weight alcohol processing aid;

(C) injecting the molten organic phase into the aqueous phase;

(D) mixing during the injection to form a mixture;

(E) adding a solution of an electrolyte to the mixture;

(F) milling the mixture to form a milled product;

(G) cooling the milled product to a temperature of from about 15° C. to about 30° C.; and (H) adding an additional amount of electrolyte to form a liquid fabric softening composition wherein the viscosity of the end composition is less than about 100 centipoise.

The process may further include the steps of adding a chelating agent to step (E) of the above process or adding a compound selected from the group consisting of chelating agents, perfumes, chlorine scavenging agents, phase stabilizing agents, dyes and mixtures thereof to just before step (H) of the above process. Preferably, a sufficient amount of electrolyte is added to the process such that the viscosity of the liquid fabric softening composition is less than about 100 centipoise and the pH of the fabric softening composition is from about 2 to about 5. Preferably, the dispersible polyethylene is added as an emulsion or suspension of polyethylene and the polyethylene is an oxidized polyethylene, and the electrolyte is selected from calcium chloride, magnesium chloride and mixtures thereof.

Accordingly, it is an object of the present invention to provide a method for making a liquid fabric softening composition including a dispersible polyolefin. It is another object of the present invention to provide a method for making a liquid fabric softening composition including a dispersible polyethylene. It is yet another aspect of the present invention to provide a method for making a liquid fabric softening composition including a dispersible polyethylene wherein the dispersible polyethylene is added before the formation of the softener vesicles. These, and other, objects, features and advantages of the present invention will be clear from the following detailed description and the appended claims.

All percentages, ratios and proportions herein are on a weight basis unless otherwise indicated. All documents cited herein are hereby incorporated by reference.

DETAILED DESCRIPTION OF THE PREFERRED EMBODIMENTS

The present invention relates to a process for making a liquid fabric softening composition including a dispersible polyolefin in the liquid composition. The difficulty in formulating a liquid fabric softening composition including a dispersible polyolefin comes with the addition of the dispersible polyolefin. During the formulation of a liquid fabric softening composition, the fabric softening component is being generally fatty in nature and is substantially insoluble in aqueous solution. The fabric softening component, rather, is formed into vesicles or spherical droplets called liposomes of fabric softening compound and water and various other ingredients, which are stably suspended in the liquid composition. Polyolefin is also substantially insoluble in aqueous solution. It also must be stably suspended as particles in aqueous solution. The difficulties in formulation involve viscosity instability issues which can arise when adding certain polyolefin emulsions to the fabric softener. There is also potential for the dispersible polyolefin to flocculate or agglomerate in the fabric softerner matrix.

The present invention solves these difficulties by formulating a fabric softening composition including a dispersible polyolefin by adding the dispersible polyolefin before formation of the softener vesicles. While not wishing to be bound by theory, it is believed that by forming the softener vesicles after addition of the polyolefin, that the polyolefin is contained within the vesicles upon their formation.

The process of the present invention comprises a first step (A) of forming an aqueous phase of a dispersible polyolefin in a water seat. The water seat is preferably heated to a temperature of from about 50° C. to about 90° C. The temperature of the water seat is scaled to the temperature of the molten organic phase to be described in more detail herein below. The water seat may be acidified by the addition of an acid, preferably a mineral acid such as hydrochloric acid. However, various other acids, such as organic acids, i.e. citrates, may be employed without departing from the scope of the present invention. The pH of the acidified water seat may range from about 2 to about 7 and preferably ranges from about 2 to about 5.

The dispersible polyolefin is preferably a polyethylene, polypropylene or mixtures thereof. The polyolefin may be at least partially modified to contain various functional groups, such as carboxyl, alkylamide, sulfonic acid or amide groups. More preferably, the polyolefin employed in the present invention is at least partially carboxyl modified or, in other words, oxidized. In particular, oxidized or carboxyl modified polyethylene is preferred in the present invention.

For ease of formulation, the dispersible polyolefin is preferably introduced as a suspension or an emulsion of polyolefin dispersed by use of an emulsifying agent. The polyolefin suspension or emulsion preferably has from about 1 to about 50%, more preferably from about 10 to about 35% by weight, and most preferably from about 15 to about 30% by weight of polyolefin in the emulsion. The polyolefin preferably has a molecular weight of from about 1,000 to about 15,000 and more preferably from about 4,000 to about 10,000.

When an emulsion is employed, the emulsifier may be any suitable emulsification agent. Preferably, the emulsifier is a cationic or nonionic surfactant or mixtures thereof. Most any suitable cationic or nonionic surfactant may be employed as the emulsifier of the present invention. Preferred emulsifiers of the present invention are cationic surfactants such as the fatty amine surfactants and in particular the ethoxylated fatty amine surfactants. In particular, the cationic surfactants are preferred as emulsifiers in the present invention when the pH of the liquid fabric softener composition formulated is in the preferred range of from about 2 to about 7. The dispersible polyolefin is dispersed by use of an emulsifier or suspending agent in a ratio of emulsifier to polyolefin of from about 1:10 to about 3:1. Preferably, the emulsion includes from about 0.1 to about 50%, more preferably from about 1 to about 20% and most preferably from about 2.5 to about 10% by weight of emulsifier in the polyolefin emulsion. Polyethylene emulsions suitable for use in the present invention are available under the tradename VELUSTROL from HOECHST Aktiengesellschaft of Frankfurt am Main, Germany. In particular, the polyethylene emulsions sold under the tradename VELUSTROL PKS, VELUSTROL KPA and VELUSTROL P-40 may be employed in the compositions of the present invention.

The compositions formulated by the process of the present invention may contain from about 0.01% to about 50% by weight of the polyolefin. More preferably, the compositions include from about 0.5% to about 20% by weight and most preferably from about 0.5% to about 10% by weight of the composition. When the dispersible polyolefin is added as an emulsion or suspension of polyolefin as described above, from about 1% to about 90% by weight of the emulsion or suspension may be added.

Various other additional ingredients may be optionally added to the aqueous phase water seat in step (A), such as anti-foaming agents, dyes, preservatives, enzymes, antioxidants, chelating agents and wetting aids or surfactant concentration aids, all of which are well-known in the art. Preferred anti-foaming agents in the present invention include the silicone anti-foaming agents. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone anti-foaming agents are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone anti-foaming agents are disclosed in U.S. Pat. No. 3,455,839 which relates to compositions and processes for defoaming aqueous solutions by incorporating therein small amounts of polydimethylsiloxane fluids. Mixtures of silicone and silanated silica are described, for instance, in German Patent Application DOS 2,124,526. Preferably from about 0.01% to about 1% of silicone anti-foaming agent is used, more preferably from about 0.25% to about 0.5%.

The water seat may include additional carrier ingredients included with the water. Mixtures of water and low molecular weight, e.g., <about 100, organic solvent, e.g., lower alcohol such as ethanol, propanol, isopropanol or butanol; propylene carbonate; and/or glycol ethers, are useful as the carrier liquid. Low molecular weight alcohol's include monohydric such as $C_{1-4}$ monohydric alcohol's, dihydric (glycol, etc.) trihydric (glycerol, etc.), and polyhydric (polyols) alcohol's, such as $C_{2-6}$ polyhydric alcohol's.

In a second step (B) of the present process, a molten organic phase including a fabric softening compound is produced. The molten organic phase may be formed simultaneously to the formation of the aqueous phase (A). The molten organic phase includes a fabric softening compound in the molten state. Typically, the molten organic phase is at a temperature of from about 50° C. to about 90° C. depending upon the fabric softening compound employed. In addition to the molten fabric softening compound, the molten organic phase may also include an effective amount of a low molecular weight alcohol processing aid. Such alcohol's typically include isopropanol and preferably ethanol. The processing aid functions to lower the melting point of the fabric softening compound thereby avoiding any potential degradation of the organic fabric softening compound. The alcohol processing aid is added in amounts such that the amount of alcohol in the final end composition does not typically exceed 6% by weight alcohol in the composition.

The molten organic phase includes a fabric softening component, optional processing aid and may optionally contain various other ingredients such as concentration aids, co-softening compounds, polyethylene glycol dispersing agents, scum inhibiting agents and anti-foaming agents, all of which are well-known in the art. The fabric softening compound employed in the present invention includes a quaternary ammonium fabric softening compound or an amine precursor or preferably a cationic quaternary ammonium fabric softening compound or precursor thereof.

Cationic Quaternary Ammonium Compounds

The preferred quaternary ammonium compounds or amine precursors of the present invention are cationic biodegradable quaternary ammonium compounds having the formula (I) or (II), below:

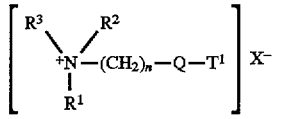

(I)

or

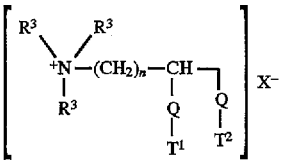

(II)

wherein Q, n, R and T are selected independently and

Q is —O—C(O)— or —C(O)—O— or —O—C(O)—O— or —$NR^4$—C(O)— or —C(O)—$NR^4$—;

$R^1$ is $(CH_2)_n$—Q—$T^2$ or $T^3$ or $R^3$, $R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1, T^2, T^3, T^4, T^5$ are (the same or different) $C_{11}$–$C_{22}$ alkyl or alkenyl;

n and m are integers from 1 to 4; and $X^-$ is a softener-compatible anion, such as chloride, methyl sulfate, etc.

The alkyl, or alkenyl, chain $T^1, T^2, T^3, T^4, T^5$ must contain at least 11 carbon atoms, preferably at least 16 carbon atoms. The chain may be straight or branched.

Q, n, $T^1$, and $T^2$ may be the same or different when more than one is present in the molecule.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Preferred quaternary ammonium compounds or amine precursors thereof include those of formula (I) or (II) wherein Q is —O—C(O)—, $R^1$ is $(CH_2)_n$—Q—$T^2$, $R^2$ and $R^3$ are the same or different and are $C_1$–$C_4$ alkyl or $C_1$–$C_4$ hydroxyalkyl or H; $T^1$ and $T^2$ are (the same or different) $C_{11}$–$C_{22}$ alkyl or alkenyl; n and m are integers from 1 to 4; and $X^-$ is a softener-compatible anion, such as chloride, methyl sulfate, etc.

Specific examples of quaternary ammonium compounds of formula (I) or (II) suitable for use in the aqueous fabric softening compositions herein include:

1) N,N-di(tallowyl-oxy-ethyl)-N,N-dimethyl ammonium chloride;

2) N,N-di(tallowyl-oxy-ethyl)-N-methyl, N-(2-hydroxyethyl)ammonium chloride;

3) 1,2-ditallowyloxy-3-N,N,N-trimethylammoniopropane chloride; and mixtures of any of the above materials.

Of these, compounds 1–2 are examples of compounds of Formula (I); compound 3 is a compound of Formula (II).

Particularly preferred is N,N-di(tallowoyl-oxy-ethyl)-N, N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentrability.

For compounds of Formula (I) made from tallow fatty acids having a IV of above 25, the ratio of cis to trans isomers has been found to be less critical unless very high concentrations are needed.

At least 80% of the preferred diester quaternary ammonium compounds, i.e., DEQA of formula (I) and (II) is preferably in the diester form, and from 0% to about 20%, preferably less than about 15%, more preferably less than about 10%, can be monoester, i.e., DEQA monoester (e.g., containing only one —Q—$T^1$ group). As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

Other examples of suitable quaternary ammonium compounds of Formula (I) and (II) are obtained by, e.g., replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, the amines being substantially protonated in the present compositions due to the claimed pH values.

Other formula (I) quaternary ammonium compounds useful as fabric softeners in the present invention include:

(i) diamido quaternary ammonium salts having the formula:

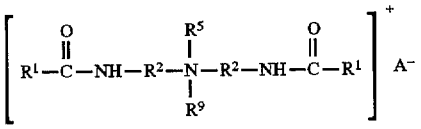

wherein $R^1$ is an acyclic aliphatic $C_{15}$–$C_{21}$ hydrocarbon group, each $R^2$ is the same or different divalent alkylene group having 1 to 3 carbon atoms, $R^5$ and $R^9$ are $C_1$–$C_4$ saturated alkyl or hydroxyalkyl groups, or $(CH_2CH_2O)_nH$ wherein n is equal to 1 to about 5 and $A^-$ is an anion;

(ii)

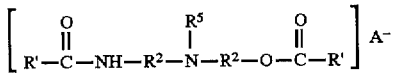

wherein $R^1$ is an acyclic aliphatic $C_{15}$–$C_{21}$ hydrocarbon group, $R^2$ is the same or different divalent alkylene group having 1 to 3 carbon atoms, $R^5$ are $C_1$–$C_4$ saturated alkyl or hydroxyalkyl groups, $A^-$ is an anion and $R^2$ is the same or different from the other $R^2$, and (iii) mixtures thereof.

Examples of compounds of (i) or (ii) as described above are the well-known and include methyl bis (tallowamidoethyl)(2-hydroxyethyl)ammonium methylsulfate and methyl bis(hydrogenated tallowamidoethyl)(2-hydroxyethyl)ammonium methylsulfate; these materials are available from Witco Chemical Company under the trade names Varisoft® 222 and Varisoft® 110, respectively: The quaternary ammonium or amine precursors compounds herein are present at levels of from about 0.05% to about 50% by weight of compositions herein, depending on the composition execution which can be dilute with a preferred level of active from about 5% to about 15% by weight, or concentrated, with a preferred level of active from about 15% to about 50%, most preferably about 15% to about 35% by weight, or from about 15% to about 50% for high quat/low polyolefin and 0.05% to about 15% for low quat/high polyolefin formulations which will be described in more detail herein.

For the preceding fabric softening agents, the pH of the compositions produced herein is an important parameter of the present invention. Indeed, it influences the stability of the quaternary ammonium or amine precursors compounds, especially in prolonged storage conditions. The pH, as defined in the present context, is measured in the neat compositions at 20° C. The pH of compositions produced by the present invention may range from about 2 to about 7. The pH of the composition produced will depend upon the stability of various ingredients including the quaternary ammonium fabric softening compound. The pH of the compositions produced herein can be regulated by the addition of a Bronsted acid.

In addition, since the foregoing compounds (diesters) are somewhat labile to hydrolysis, they should be handled rather carefully when used herein. For example, stable liquid compositions produced herein are formulated at a pH (neat) in the range of from about 2 to about 7, preferably from about 2 to about 5, more preferably from about 2 to about 4.5. For best product odor stability, when the IV is greater that about 25, the neat pH is from about 2.8 to about 3.5, especially for lightly scented products. This appears to be true for all of the above softener compounds and is especially true for the preferred DEQA specified herein, i.e., having an IV of greater than about 20, preferably greater than about 40. The limitation is more important as IV increases. The pH can be adjusted by the addition of a Bronsted acid as described above. pH ranges for making chemically stable softener compositions containing diester quaternary ammonium fabric softening compounds are disclosed in U.S. Pat. No. 4,767,547, Straathof et al., issued on Aug.30, 1988, which is incorporated herein by reference.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Alternative Cationic Ammonium Compounds

Additional cationic fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. No. :

3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; and European Patent Application publication No. 472,178, by Yamamura et al., the disclosures of which are all herein incorporated by reference.

For example, additional cationic fabric softener agents useful herein may comprise one or two of the following fabric softening agents:

(a) the reaction product of higher fatty acids with a polyamine selected from the group consisting of hydroxyalkylalkylenediamines and dialkylenetriamines and mixtures thereof (preferably from about 10% to about 80%); and/or (b) cationic nitrogenous salts containing long chain acyclic aliphatic $C_{15}$–$C_{22}$ hydrocarbon groups (preferably from about 3% to about 40%); with said (a) and (b) preferred percentages being by weight of the fabric softening agent component of the present invention compositions.

Following are the general descriptions of the preceding (a) and (b) softener ingredients (including certain specific examples which illustrate, but do not limit the present invention).

Component (a): Softening agents (actives) of the present invention may be the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (a) is a nitrogenous compound selected from the group consisting of the reaction product mixtures or some selected components of the mixtures. More specifically, the preferred Component (a) is compounds selected from the group consisting of substituted imidazoline compounds having the formula:

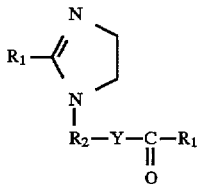

wherein $R^1$ is an acyclic aliphatic $C_{15}$–$C_{21}$ hydrocarbon group and $R^2$ is a divalent $C_1$–$C_3$ alkylene group, and Y is NH or O.

Component (a) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$–$C_{17}$ hydrocarbon group and $R^2$ is a divalent ethylene group).

Certain of the Components (a) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

Component (b): The preferred Component (b) is a cationic nitrogenous salt, preferably selected from acyclic quaternary ammonium salts having the formula:

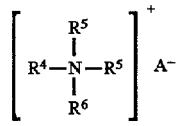

wherein $R^4$ is an acyclic aliphatic $C_{15}$–$C_{22}$ hydrocarbon group, $R^5$ is $R^4$ or $C_1$–$C_4$ saturated alkyl or hydroxy alkyl groups, and $R^6$ is $R^4$ or $R^5$ and A_ is an anion.

Examples of Component (b) are the monoalkyltrimethylammonium salts such as monotallowtrimethylammonium chloride, mono(hydrogenatedtallow)trimethylammonium chloride, palmityltrimethyl ammonium chloride and soyatrimethylammonium chloride, sold by Witco Chemical Company under the trade name Adogen® 471, Adogen® 441, Adogen® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred. Further examples include dialkyldi methylammonium salts such as ditallowdimethylammonium chloride. Examples of commercially available dialkyldimethyl ammonium salts usable in the present invention are di(hydrogenated tallow) dimethylammonium chloride (tradename Adogen® 442), ditallowdimethyl ammonium chloride (trade name Adogen® 470), distearyl dimethylammonium chloride (trade name Arosurf® TA-100), all available from Witco Chemical Company, dimethylstearylbenzyl ammonium chloride sold under the trade names Varisoft® SDC by Witco Chemical Company and Ammonyx® 490 by Onyx Chemical Company. Also preferred are those selected from the group consisting of di(hydrogenated tallow) dimethylammonium chloride, ditallowdimethylammonium chloride. Mixtures of the above examples are also included within the scope of the present invention.

A preferred compound of Component (a) include the reaction product of about 2 moles of hydrogenated tallow fatty acids with about 1 mole of N-2-hydroxyethylethylenediamine or diethylene triamine and is present at a level of from about 20% to about 70% by weight of the fabric softening component of the present invention compositions while preferred compounds of component (b) include mono(hydrogenated tallow)trimethyl ammonium chloride and di(hydrogenated tallow)dimethyl ammonium chloride present at a level of from about 3% to about 30% by weight of the fabric softening component of the present invention compositions; 1-tallowamidoethyl-2-tallowimidazoline, and mixtures thereof; wherein mixtures of compounds of (a) and (b) are present at a level of from about 20% to about 60% by weight of the fabric softening component of the present invention compositions; and wherein the weight ratio of said di(hydrogenated tallow)

dimethylammonium chloride to said 1-tallowamidoethyl-2-tallowimidazoline is from about 1:2 to about 6:1.

In the cationic nitrogenous salts described herein before, the anion A_ provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion A_.

Nonionic Softening Compounds

Softening agents also useful in the present invention are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g.>40° C.) and relatively water-insoluble.

The level of optional nonionic softener in the compositions herein is typically from about 0% to about 10%, preferably from about 1% to about 5% by weight of the composition.

Preferred nonionic softeners are fatty acid partial esters of polyhydric alcohol's, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid, oleic and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described herein before for the sorbitan and glycerol esters.

Liquid compositions produced by this invention typically contain from about 0.05% to about 50%, preferably from about 2% to about 40%, more preferably from about 4% to about 32%, of quaternary ammonium softener active. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

Once prepared, the aqueous phase is transferred to a mixing device. The aqueous phase is maintained at a temperature of from about 50° C. to about 90° C. While the type of mixing device is not critical to the present invention, a insulated baffled mixing vessel fitted with a turbine blade impeller is preferred. Of course, one of ordinary skill in the art will recognize that various other types of mixing vessels may be employed without departing from the scope of the present invention.

In a third step (C) of the present invention, the molten organic phase, maintained at a temperature of from about 50° C. to about 90° C., is added or injected to the aqueous phase in the mixing vessel. The molten organic phase is added slowly and preferably under high speed agitation. Typical rates of addition of the molten organic phase in laboratory formulation work are about 50 grams per minute while typical agitation rates are about 200 rpm at the beginning of the addition, ramping up to about 2500 rpm as the mixture becomes more viscous. The mixture becomes a highly viscous paste.

In a next step (D) of the present process, a solution of a suitable electrolyte is added to the mixture to begin the formation of the softener vesicles and to thin the viscous mixture. Electrolytes suitable for use in the present invention include inorganic water-soluble, ionizable salts. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. Particularly preferred are calcium chloride and magnesium chloride. The amount of ionizable salts used depends on the amount of active ingredients used in the end compositions and can be adjusted according to the desires of the formulator. The electrolyte is added in a range of from about 400 ppm to about 7,000 ppm of the mixture, more preferably from about 1,000 ppm to about 5,000 ppm and most preferably from about 2,000 to about 4,000 ppm of the mixture. The electrolyte is preferably added as a solution which typically has a concentration of from about 1% to about 30% by weight of the electrolyte. Upon addition of the electrolyte solution the mixtures transforms from a viscous paste to a thin fluid, typically having an viscosity of below about 300 centipoise.

Optionally, the thinned mixture may then be milled using a high shear mixing device. While not required, milling is a preferred option to reduce the particle size of the softener vesicles. While the type of milling device is not critical to the present invention, the preferred milling device is a probe rotor-stator high shear milling device. Of course, one of ordinary skill in the art will recognize that various other milling devices including in-line milling devices in a continuous process may be employed without departing from the scope of the present invention. The mixture is milled for a period of time corresponding to the batch size within the mixing device. For typical batch sizes of from about 200 to about 1,000 grams, milling times of approximately 2 minutes with a rotor-stator device under high shear conditions are typical. Of course, flow through rates for continuous in-line devices in a continuous process are adjusted to appropriate rates The thinned, and preferably milled, mixture is then cooled to from about 15° C. to about 30° C., more preferably to room temperature. Cooling times may vary depending upon the target temperature, the device employed and the size of the batch being cooled. Preferably, the mixture is cooled to the preferred range of temperature in from about 2 to about 8 minutes, preferably from about 4 to about 6 minutes via the use of an ice bath. Of course, one of ordinary skill in the art will recognize that the type of cooling device employed, such as Ke bath or in-line heat exchanger for a continuous process, or the rate the rate of cooling may vary without departing from the scope of the present invention.

Once cooled, additional amounts of electrolyte are then added to form the final liquid fabric softening composition. In this step, from about 2000 ppm to about 20,000 ppm, and more preferably from about 4,000 ppm to about 18,000 ppm of electrolyte are added to the composition. The total amount of added electrolyte in the end compositions of the present invention may range from about 2000 to about 25,000, preferably from about 2000 to about 20,000 ppm. The end liquid fabric softening composition is a very fluid mixture having a viscosity of less than about 100 centipoise, and preferably less than about 75 centipoise. The pH of the end composition typically will be within the range of from about 2 to about 7 and more preferably from about 2 to about 5.

Various optional ingredients may be added to the cooled mixture. When adding additional ingredients it is desirable to add these remaining ingredients prior to the addition of remaining electrolyte. Remaining ingredients which may be added include, but are not limited to, phase stabilizing agents, chelating agents, perfumes, dyes, and chlorine scavenging agents. A small amount of total chelating agent may be added with the first addition of electrolyte after the mixing of the molten organic phase and the aqueous phase, while the remainder may be added after the mixture has been cooled. The order of addition of the above mentioned additional ingredients is important to the make-up of the final solution. All additional ingredients, and most importantly perfume, should be added before the final electrolyte addition. Phase stabilizing agents should be added prior to the addition of the remaining amounts of chelating agents. When employing pH-sensitive fabric softening compounds, the chelating agents are preferably added as acidified solutions with a pH close to that of the pH sensitive fabric softening compound to avoid localized pH shifts which can impact softener stability and affect the viscosity of the end composition. Additional ingredients are all preferably added to the composition with vigorous mixing.

Phase Stabilizers

Phase stabilizers can be present in the end compositions of the process of the present invention, and must be present to ensure phase and viscosity stability when the compositions contain relatively high levels of ionic strength. Various types of stabilizing agents are well-known in the art such as anti-oxidants and reductive agents. Particularly preferred stabilizing agents include water soluble polyesters. These compounds may be prepared by art recognized methods. The following illustrates this synthesis; more details can be found in U.S. Pat. No. 4,702,857, Gosselink, issued Oct. 27, 1,702,857.

The stabilizers are water-soluble polyesters which can be formed from: (1) ethylene glycol, 1,2-propylene glycol or a mixture thereof; (2) a polyethylene glycol (PEG) capped at one end with a $C_1$–$C_4$ alkyl group; and (3) a dicarboxylic acid (or its diester). The respective amounts of these components are selected to prepare polyesters having the desired properties in terms of solubility and stabilizing properties.

The capped PEG used to prepare polyesters of the present invention is typically methyl capped and can be formed by ethoxylation of the respective alcohol with ethylene oxide. Also, methyl capped PEGs are commercially available from Union Carbide under the trade name Methoxy Carbowax and from Aldrich Chemical Company under the name poly (ethylene glycol)methyl ether. These commercial methyl capped PEGs have molecular weights of 350 (n=about 7.5), 550 (n=about 12), 750 (n-about 16), 1900 (n=about 43), and 5000 (n=about 113).

Preferably, the only dicarboxylic acid used is terephthalic acid or its diester. However, minor amounts of other aromatic dicarboxylic acids (or their diesters), or aliphatic dicarboxylic acids (or their diesters) can be included to the extent that the stabilizing properties are substantially maintained. Illustrative examples of other aromatic dicarboxylic acids which can be used include isophthalic acid, phthalic acid, naphthalene dicarboxylic acids, anthracene dicarboxylic acids, biphenyl dicarboxylic acids, oxydibenzoic acids and the like, as well as mixtures of these acids. Of aliphatic dicarboxylic acids are included: adipic, glutaric, succinic, trimethyladipic, pimelic, azelaic, sebacic, suberic, 1,4-cyclohexane dicarboxylic acid and/or dodecanedioic acids can be used.

The preferred method for preparing block polyesters used in the present invention comprises reacting the desired mixture of lower dialkyl esters (methyl, ethyl, propyl or butyl) of the dicarboxylic acid with a mixture of the glycol (ethylene glycol, 1,2-propylene glycol or a mixture thereof) and the capped PEG. The glycol esters and oligomers produced in this ester interchange reaction are then polymerized to the desired degree. The ester interchange reaction can be conducted in accordance with reaction conditions generally used for ester interchange reactions. This ester interchange reaction is usually conducted at temperatures of from 120° C. to 220° C. in the presence of an esterification catalyst. Alcohol is formed and constantly removed thus forcing the reaction to completion. The temperature and pressure of the reaction are desirably controlled so that glycol does not distill from the reaction mixture. Higher temperatures can be used if the reaction is conducted under pressure.

The catalysts used for the ester interchange reaction are those well known to the art. These catalysts include alkyl and alkaline earth metals, for example lithium, sodium, calcium, and magnesium, as well as transition and Group IIB metals, for example, antimony, manganese, cobalt, and zinc, usually as the respective oxides, carbonates and acetates. Typically, antimony trioxide and calcium acetate are used.

The extent of the ester interchange reaction can be monitored by the amount of alcohol liberated or the disappearance of the dialkyl esters of the dibasic acids in the reaction mixture as determined by high performance liquid chromatography (HPLC) or any other suitable method. The ester interchange reaction is desirably taken to more than 90% completion. Greater than 95% completion is preferred in order to decrease the amount of sublimates obtained in the polymerization step.

When the ester interchange reaction is complete, the glycol ester products are then polymerized to produce polyesters. The desired degree of polymerization can be determined by HPLC and $^{13}$C-NMR analysis. For commercial processes, the polymerization reaction is usually conducted at temperatures of from about 200° C. to about 280° C. in the presence of a catalyst. Higher temperatures can be used but tend to produce darker colored products. Illustrative examples of catalysts useful for the polymerization step include antimony trioxide, germanium dioxide, titanium alkoxide, hydrated antimony pentoxide, and ester interchange catalysts such as the salts of zinc, cobalt, and manganese. Excess glycol and other volatiles liberated during the reaction are removed under vacuum, as described by Gosselink.

The resulting, preferred polymer materials for use herein may be represented by the formula:

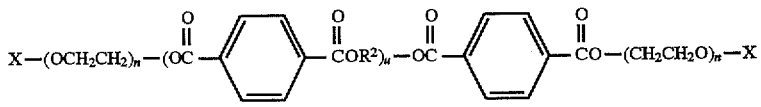

wherein $R^2$ is selected from the group consisting of 1,2-propylene (preferred), ethylene, or mixtures thereof; each X is $C_1$-$C_4$ alkyl (preferably methyl); each n is from about 12 to about 50; and u is from about 1 to about 10. Preferably, each n is 40 and u is 4.

The storage stability of the compositions herein can be assessed by a simple visual test. The compositions are prepared, placed in clear containers, and allowed to stand undisturbed at any desired temperature. Since the vesicles of fabric softener are lighter than the aqueous carrier, the formation of a relatively clear phase at the bottom of the container will signify a stability problem. Stable compositions prepared in the present manner will withstand such a test for weeks, or even months, depending somewhat on temperature. Conversely, unstable compositions will usually exhibit phase separation in a matter of a few days, or less. Alternatively, stability can be assessed by measuring changes in viscosity after storage.

The stabilizer polymers are used herein in a "stabilizing amount", i.e., an amount sufficient to prevent the aforementioned phase separation, as well as unacceptable viscosity shifts in the finished product. This amount can vary somewhat, depending on the amount of cationic fabric softener, the amount of electrolyte, the level of cationic fabric softener and the level of electrolyte in the finished product, the type of electrolyte and the particular stabilizer polymer chosen.

The stability of the finished compositions can also be affected somewhat by the type of electrolyte or other ionic additives which may be present. However, this can be accounted for routinely by adjusting the level of stabilizer polymer. The polymer stabilizers will typically comprise from about 0.1% to about 2%, by weight of the compositions herein, and more preferably from about 0.25–1% by weight of the compositions herein. The compositions are stable on storage, and the amount of polyester plus other ingredients therein is typically sufficient to provide a preferred viscosity in the range of from about 30 cps to about 80 cps which remains stable over time (Brookfield LVT Viscometer; Spindle #2; 60 rpm; room temperature, ca. 25° C.).

Chelating Agent

The end compositions produced by the process herein may employ one or more transition metal ion chelates (Fe, Ni and Cu)("chelators"). Such water-soluble chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove metal ions such as iron, copper, nickel, manganese and the like from rinse solutions by formation of soluble chelates. These chelating agents also appear to interact with dyes and optical brighteners on fabrics which have already been undesirably affected by interactions with copper or nickel cations in the laundry process, with the attendant color change and/or drabness effects. By the end compositions of the present invention, the whiteness and/or brightness of such affected fabrics are substantially improved or restored.

Amino carboxylates useful as chelating agents herein include ethylenedi-aminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DTPA), and ethanoldiglycines, including their water-soluble salts such as the alkali metal, ammonium, and substituted ammonium salts thereof and mixtures thereof.

Amino phosphonates are also suitable for use as chelating agents in the end compositions of the invention when at least low levels of total phosphorus are permitted in detergent compositions, and include ethylenediaminetetrakis (methylenephosphonates), diethylenetriamine-N,N,N',N", N"-pentakis(methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 50 ppm, for periods from 1 minute up to several hours' soaking.

The preferred EDDS chelator used herein (also known as ethylenediamine-N,N'-disuccinate) is the material described in U.S. Pat. No. 4,704,233, cited hereinabove, and has the formula (shown in free acid form):

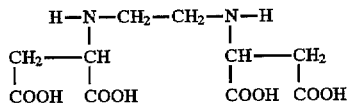

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. As noted hereinafter, at certain pH's the EDDS is preferably used in combination with zinc cations.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 99%, more preferably from about 0.1% to about 15%, and most preferably from about 0.1% to about 10%, by weight of the compositions herein. Preferred chelators include DETMP, DTPA, NTA, EDDS and mixtures thereof.

Chlorine Scavenging Agents

Chlorine is used in many parts of the world to sanitize water. To ensure that the water is safe, a small residual amount, typically about 1 to 2 parts per million (ppm), of chlorine is left in the water. At least about 10% of U.S. households has about 2 ppm or more of chlorine in its tap water at some time. It has been found that this small amount of chlorine in the tap water can also contribute to fading or color changes of some fabric dyes. Thus, chlorine-induced fading of fabric colors over time can result from the presence of residual chlorine in the rinse water. Accordingly, in addition to the chelator, the present invention preferably also employs a chlorine scavenger. Moreover, the use of such chlorine scavengers provides a secondary benefit due to their ability to eliminate or reduce the chlorine odor on fabrics.

Chlorine scavengers are materials that react with chlorine, or with chlorine-generating materials, such as hypochlorite, to eliminate or reduce the bleaching activity of the chlorine materials. For color fidelity purposes, it is generally suitable to incorporate enough chlorine scavenger to neutralize about 1–10 ppm chlorine in rinse water, typically to neutralize at least about 1 ppm in rinse water. For the additional elimination or reduction of fabric chlorine odor resulting from the use of a chlorine bleach in the wash, the compositions should contain enough chlorine scavenger to neutralize at least about 10 ppm in rinse water.

End compositions produced according to the present invention provide about 0.1 ppm to about 40 ppm, preferably from about 0.2 ppm to about 20 ppm, and more preferably from about 0.3 ppm to about 10 ppm of chlorine scavenger to an average rinse bath. Suitable levels of chlorine scavengers range from about 0.01% to about 10%, preferably from about 0.02% to about 5%, most preferably from about 0.03% to about 4%, by weight of total composition. If both the cation and the anion of the scavenger react with chlorine, which is desirable, the level may be adjusted to react with an equivalent amount of available chlorine.

Non-limiting examples of chlorine scavengers include primary and secondary amines, including primary and secondary fatty amines; ammonium salts, e.g., chloride, sulfate; amine-functional polymers; amino acid homopolymers with amino groups and their salts, such as polyarginine, polylysine, polyhistidine; amino acid copolymers with amino groups and their salts; amino acids and their salts, preferably those having more than one amino group per molecule, such as arginine, histidine, not including lysine reducing anions such as sulfite, bisulfite, thiosulfate, nitrite; antioxidants such as ascorbate, carbamate, phenols; and mixtures thereof. Ammonium chloride is a preferred inexpensive chlorine scavenger for use herein.

Other useful chlorine scavengers include water-soluble, low molecular weight primary and secondary amines of low volatility, e.g., monoethanolamine, diethanolamine, tris (hydroxymethyl)aminomethane, hexamethylenetetramine. Suitable able amine-functional chlorine scavenger polymers include: water-soluble polyethyleneimines, polyamines, polyvinylamines, polyamineamides and polyacrylamides. The preferred polymers are polyethyleneimines, the polyamines, and polyamineamides. Preferred polyethyleneimines have a molecular weight of less than about 2000, more preferably from about 200 to about 1500.

Various other ingredients which may be added include, but are not limited to, dye transfer inhibiting agents, cellulase enzymes, polymeric dispersing agents, optical brighteners or other brightening or whitening agents, dye fixing agents, light fading protection agents, oxygen bleach protection agents, fabric softening clay, anti-static agents, other active ingredients, carriers, hydrotropes, bacteriocides, colorants, preservatives, opacifiers, anti-shrinkage agents, anti-wrinkle agents, fabric crisping agents, spotting agents, germicides, fungicides, anti-corrosion agents, and the like. All of these ingredients are well-known to one of ordinary skill in the art and need not be discussed in greater detail.

The following examples illustrate the compositions of this invention, but are not intended to be limiting thereof.

EXAMPLE I

Liquid fabric softening compositions produced via the process of the present invention are formulated as follows:

| Ingredient | A Wt. % | B Wt. % | C Wt. % | D Wt. % | E Wt. % | F Wt. % |
|---|---|---|---|---|---|---|
| Fabric Softening Compound (1) | 24.0 | — | 25.0 | — | — | — |
| Fabric Softening Compound (2) | — | 19.2 | — | — | — | — |
| Fabric Softening Compound (3) | — | — | — | 18.0 | — | — |
| Fabric Softening Compound (4) | — | — | — | — | 11.0 | 4.0 |
| Fabric Softening Compound (5) | — | — | — | — | 13.5 | — |
| Fabric Softening Compound (6) | — | — | — | — | — | 3.4 |
| Ethanol | 4.0 | — | 4.0 | — | 5.0 | 1.0 |
| Isopropanol | — | 3.0 | — | 6.0 | — | — |
| VELUSTROL PKS (7) | 3.0 | 3.0 | — | — | — | — |
| VELUSTROL KPA (8) | — | — | 3.0 | 3.0 | — | — |
| VELUSTROL P-40 (9) | — | — | — | — | 3.0 | 3.0 |
| Calcium Chloride | 2.0 | 0.2 | 0.6 | 0.5 | 0.5 | 0.05 |
| Chelant (10) | 2.5 | — | — | — | — | — |
| Hydrochloric acid | 0.75 | 0.06 | 0.05 | 0.02 | — | 0.2 |
| Phase Stabilizer (11) | 0.5–1 | 0.2 | 0.5 | — | — | — |
| Silicone Anti-foam | 0.01 | 0.01 | 0.01 | — | — | 0.01 |

-continued

| Ingredient | A Wt. % | B Wt. % | C Wt. % | D Wt. % | E Wt. % | F Wt. % |
|---|---|---|---|---|---|---|
| Misc. | 1.4 | 0.7 | 1.3 | 1.0 | 1.0 | 0.4 |
| Water | to 100 | to 100 | to 100 | to 100 | to 100 | to 100 |

(1) N,N-di(tallowyl-oxy-ethyl)-N,N-dimethyl ammonium chloride (IV 50)
(2) N,N-di(tallowyl-oxy-ethyl)-N,N-dimethyl ammonium chloride (IV 18)
(3) 1,2-ditallowyloxy-3-N,N,N-trimethylammoniopropane chloride
(4) Ditallow dimethyl ammonium chloride
(5) Methyl bis (tallow amidoethyl) 2-hydroxyethyl ammonium methyl sulfate
(6) 1-tallowamidoethyl-2-tallowimidazoline
(7) Cationic polyethylene emulsion available from HOECHST Aktiengesellschaft
(8) Cationic polyethylene emulsion available from HOECHST Aktiengesellschaft
(9) Nonionic polyethylene emulsion available ftom HOECHST Aktiengesellschaft
(10) Sodium diethylenetriamine pentaacetate
(11) Dimethyl-terephthalate, 1,2 propylene glycol, methyl capped PEG polymer

EXAMPLE II

The liquid fabric softening composition of EXAMPLE 1, formula A is prepared as follows:

The fabric softening compound containing ethanol is melted in a water bath at a temperature of from about 70° to about 75° C. to from a molten organic phase. Separately, a dispersible polyethylene emulsion, silicone anti-foaming agent and hydrochloric acid are added to water, covered and heated to a temperature of from about 70° to about 75° C.

The aqueous system is transferred to an insulated baffled mixing vessel which is fitted with a turbine blade impeller. The molten organic phase is slowly added to the aqueous phase under high speed agitation. The dispersion becomes highly viscous. A small portion of the total calcium chloride is slowly added to the dispersion as a 2.5% solution. A small portion of the total chelant, pre-acidified with hydrochloric acid is added to create a very fluid dispersion.

The dispersion is milled using a probe rotor-stator high shear device for a period of time corresponding to batch size. The milled product is chilled in an ice bath to room temperature over a 3–6 minute period. In sequence, phase stabilizer, remaining acidified chelant, perfume, ammonium chloride and remaining calcium chloride are added with vigorous mixing. Dye may then be added as desired. The final product is very fluid with a viscosity of less than 100 centipoise and has a pH of about 3.

EXAMPLE III

The liquid fabric softening composition of EXAMPLE 1, formula B is prepared as follows:

The fabric softening compound containing isopropanol is melted in a water bath at a temperature of from about 75° to about 80° C. to from a molten organic phase. Separately, a dispersible polyethylene emulsion, silicone anti-foaming agent and hydrochloric acid are added to water, covered and heated to a temperature of from about 75° to about 80° C.

The aqueous system is transferred to an insulated baffled mixing vessel which is fitted with a turbine blade impeller. The molten organic phase is slowly added to the aqueous phase under high speed agitation. The dispersion becomes highly viscous. A portion of the total calcium chloride is slowly added to the dispersion as a 25% solution until viscosity is drastically reduced The dispersion is chilled to ambient temperature in an ice bath to over a 3–6 minute period. In sequence, phase stabilizer, perfume, and remaining calcium chloride are added with vigorous mixing. Dye may then be added as desired. The final product is very fluid with a viscosity of less than 100 centipoise and has a pH of about 3.

EXAMPLE IV

The liquid fabric softening composition of EXAMPLE 1, formula C is prepared as follows:

The fabric softening compound containing ethanol is melted in a water bath at a temperature of from about 70° to about 75° C. to from a molten organic phase. Separately, a dispersible polyethylene emulsion, silicone anti-foaming agent and hydrochloric acid are added to water, covered and heated to a temperature of from about 70° to about 75° C.

The aqueous system is transferred to an insulated baffled mixing vessel which is fitted with a turbine blade impeller. The molten organic phase is slowly added to the aqueous phase under high speed agitation. The dispersion becomes highly viscous. A small portion of the total calcium chloride is slowly added to the dispersion as a 25% solution.

The dispersion is milled using a probe rotor-stator high shear device for a period of time corresponding to batch size. The milled product is chilled in an ice bath to room temperature over a 3–6 minute period. In sequence, phase stabilizer, perfume, ammonium chloride and remaining calcium chloride are added with vigorous mixing. Dye may then be added as desired. The final product is very fluid with a viscosity of less than 100 centipoise and has a pH of about 3.

What is claimed is:

1. A process for making a liquid fabric softening composition including a dispersible polyolefin comprising the steps of:

(A) forming an aqueous phase comprising a dispersible polyolefin having a temperature of from about 50° C. to about 90° C.;

(B) forming a molten organic phase having a temperature of from about 50° C. to about 90° C., the molten organic phase comprising a molten fabric softening compound;

(C) injecting the molten organic phase into the aqueous phase;

(D) mixing during said injection to form a mixture;

(E) adding a solution of an electrolyte to said mixture;

(F) cooling the mixture to a temperature of from about 15° C. to about 30° C.; and (G) adding an additional amount of said electrolyte to form a liquid fabric softening composition.

2. The process as claimed in claim 1 wherein said dispersible polyolefin is added as an emulsion or suspension of polyolefin.

3. The process as claimed in claim 2 wherein said dispersible polyolefin is added as an emulsion and said emulsion comprises from about 15 to about 35% by weight of polyolefin and an emulsifier.

4. The process as claimed in claim 3 wherein the ratio of emulsifier to polyolefin in the emulsion may be from about 1:10 to about 3:1.

5. The process as claimed in claim 2 wherein the suspension or emulsion of polyolefin is polyethylene.

6. The process as claimed in claim 5 wherein said polyethylene is a modified polyethylene.

7. The process as claimed in claim 6 wherein said modified polyethylene is an oxidized polyethylene.

8. The process as claimed in claim 3 wherein said emulsifier is a cationic or nonionic surfactant.

9. The process as claimed in claim 1 wherein the pH of the liquid fabric softening composition is from about 2 to about 5.

10. The process as claimed in claim 1 further comprising the step of adding a chelating agent in step (E) of said process.

11. The process as claimed in claim 1 further comprising the step of adding an anti-foaming agent to step (A) of said process.

12. The process as claimed in claim 1 further comprising the step of adding a compound selected from the group consisting of chelating agents, perfumes, chlorine scavenging agents, phase stabilizing agents, dyes and mixtures thereof at or before step (G) of said process.

13. The process as claimed in claim 1 wherein a sufficient amount of said electrolyte is added such that the viscosity of the liquid fabric softening composition is less than about 100 centipoise.

14. The process as claimed in claim 1 further comprising the step of milling said mixture before said cooling step under high shear conditions.

15. The process as claimed in claim 1 wherein said electrolyte is selected from the group consisting of calcium chloride, magnesium chloride, and mixtures thereof.

16. A process for making a liquid fabric softening composition including a dispersible polyolefin comprising the steps of:

(A) forming an aqueous phase comprising a dispersible polyethylene and a silicone anti-foaming agent in a water seat having a temperature of from about 50° C. to about 90° C.;

(B) forming a molten organic phase having a temperature of from about 50° C. to about 90° C., the molten organic phase comprising molten N,N-di(tallowyl-oxyethyl)-N,N-dimethyl ammonium chloride and a low molecular weight alcohol processing aid;

(C) injecting the molten organic phase into the aqueous phase;

(D) mixing during said injection to form a mixture;

(E) adding a solution of an electrolyte to said mixture;

(F) milling said mixture under high shear conditions to form a milled product;

(G) cooling the milled product to a temperature of from about 15° C. to about 30° C.; and (H) adding an additional amount of said electrolyte to form a liquid fabric softening composition, wherein the viscosity of said liquid fabric softening composition is less than about 100 centipoise.

17. The process as claimed in claim 16 further comprising the step of adding a chelating agent in step (E) of said process.

18. The process as claimed in claim 16 further comprising the step of adding a compound selected from the group consisting of chelating agents, perfumes, chlorine scavenging agents, phase stabilizing agents, dyes and mixtures thereof at or before step (H) of said process.

19. The process as claimed in claim 16 wherein a sufficient amount of inorganic viscosity control aid is added such that the viscosity of the liquid fabric softening composition is less than about 100 centipoise and the pH of said composition is from about 2 to about 5.

20. The process as claimed in claim 16 wherein the dispersible polyethylene is added as an emulsion or suspension of oxidized polyethylene.

21. The process as claimed in claim 16 wherein said electrolyte is selected from the group consisting of calcium chloride, magnesium chloride, and mixtures thereof.

* * * * *